US006065628A

United States Patent [19]

Page

[11] Patent Number: 6,065,628

[45] Date of Patent: May 23, 2000

[54] CONTAINER LID AND METHOD FOR MAKING SAME

[75] Inventor: Christopher I. Page, Hyannis Port, Mass.

[73] Assignee: Cleveland Steel Container, Streetsboro, Ohio

[21] Appl. No.: 09/066,019

[22] Filed: Apr. 24, 1998

[51] Int. Cl.[7] ..... B65D 41/10

[52] U.S. Cl. ..... 220/309.2; 220/284; 215/324

[58] Field of Search ..... 220/284, 309.1, 220/309.2, 310.1; 215/324, 327

[56] References Cited

U.S. PATENT DOCUMENTS

| | | | |
|---|---|---|---|
| 674,305 | 5/1901 | Patterson . | |
| 1,398,686 | 11/1921 | Graf . | |
| 1,485,136 | 2/1924 | House . | |
| 1,948,920 | 2/1934 | Johnson | 220/309.2 X |
| 2,006,938 | 7/1935 | Birkenhauer . | |
| 2,121,843 | 6/1938 | Vaughn | 220/309.2 X |
| 2,148,468 | 2/1939 | Hothersall | 220/309.2 X |
| 2,161,993 | 6/1939 | Berch et al. | 215/324 |
| 2,191,705 | 2/1940 | Chamberlain | 220/309.2 X |
| 2,205,685 | 6/1940 | Conner | 220/309.2 |
| 2,234,195 | 3/1941 | Preis . | |
| 2,343,253 | 3/1944 | Clark . | |
| 3,170,590 | 2/1965 | Ullman et al. . | |
| 3,942,679 | 3/1976 | Starr . | |
| 4,003,491 | 1/1977 | Wells et al. . | |
| 4,049,122 | 9/1977 | Maxwell . | |
| 4,089,283 | 5/1978 | Mertens et al. . | |
| 4,228,897 | 10/1980 | Underwood . | |
| 4,328,665 | 5/1982 | Taubert et al. . | |
| 4,483,456 | 11/1984 | Mays . | |
| 4,513,872 | 4/1985 | Bull . | |
| 4,597,502 | 7/1986 | Troughton . | |
| 4,635,814 | 1/1987 | Jones . | |
| 4,789,076 | 12/1988 | Jewitt et al. | 220/309 |
| 4,862,574 | 9/1989 | Seidy . | |
| 4,906,158 | 3/1990 | Dewitt et al. . | |
| 4,938,051 | 7/1990 | Duffy et al. . | |
| 4,982,858 | 1/1991 | von Holdt . | |
| 5,054,637 | 10/1991 | LaRovere . | |
| 5,086,944 | 2/1992 | Duffy et al. | 220/658 |
| 5,413,236 | 5/1995 | Kenevan . | |
| 5,685,449 | 11/1997 | Oblak . | |

FOREIGN PATENT DOCUMENTS 27 11 117 9/1978 Germany .

*Primary Examiner*—Stephen K. Cronin
*Attorney, Agent, or Firm*—Calfee, Halter & Griswold LLP

[57] ABSTRACT

A method and apparatus for making a container lug lid which minimizes scrap waste is described. The blanks for forming container lug lids therefrom comprise an odd number of dissimilar lugs with one or more of the lugs comprising a male lug. Circumferential bases are formed between each lug, with one or more of the circumferential bases having a female complementary shape for receiving a male lug of an adjacent blank. The blank pattern for cutting the blanks from a sheet of material, which is preferably scrolled, comprises arranging the blanks in a closely spaced arrangement with the male lugs positioned for alignment with an adjacent female or complementary shaped circumferential base.

18 Claims, 6 Drawing Sheets

CONTAINER LID AND METHOD FOR MAKING SAME

FIELD OF THE INVENTION

The present invention pertains generally to lid closures for use with cylindrical containers. More particularly, the invention pertains to metal lid closures having a plurality of lugs which are crimped for closing and sealing the ends of a pail or container, and to a method for making the same.

BACKGROUND OF THE INVENTION

Many types of prior art container lids have been devised for closing pails or containers. These container lids are generally applied to an open ended pail or container which has a curled annular rim formed about an open end. Prior art lids are generally disc-shaped and have a downwardly facing annular groove or channel adapted to receive the annular rim of the container. A series of lid lugs project downwardly from the annular channel of the lid for attaching the lid to the container rim. For example, lug lids for use with two and one half to seven gallon containers generally contain an even number of lugs on the order of 16 to 20 lugs, which are formed along a circumferential edge of the lid with spaces formed between the lugs. The lid is sealed to the container by use of a crimping tool to crimp the lugs about the annular rim of the container in a sealing arrangement.

These metal container lids are generally manufactured by blanking or punching a rectangular or square sheet of metal with a pattern comprising a plurality of unfolded container lids or blanks. For example, a typical prior art punch pattern is shown in FIG. 1, and comprises four closely spaced unfolded container lids which are symmetrical in shape. One major disadvantage of the prior art container lid design and punch pattern is that costly material is wasted in between the holes (i.e., the scrap skeleton) even though the blanks are closely spaced together. In addition, a larger sheet of material is required than necessary in order to produce a given number of container lids. This waste is a function of the container lid design and the amount of spacing allotted for adjacent blanks. Scrap material represents an expensive loss which is only partly recoverable and which requires additional resources to convert into a usable form. Another disadvantage of the prior art is that more time is wasted in gathering and transporting the scrap to recycling centers. Yet another disadvantage of the prior art is that paint used to coat the sheet prior to punching is wasted as well as the additional energy required to cure the paint on a larger sheet.

It is therefore desirable to provide an improved container lid design and blank pattern layout which reduces the amount of scrap material generated and thus results in considerable cost savings with very few drawbacks. It is further desirable to provide an improved container lid design and blank pattern layout which reduces the sheet size of the material while producing an equivalent number of lids.

SUMMARY OF THE INVENTION

In accordance with the teaching of this invention a container lid is provided, together with a process for making the same in which the container lid is capable of being inexpensively manufactured with minimal material waste being generated and while having the advantages enjoyed by prior art container lids.

The invention provides in one aspect a lug lid for sealing a container having an annular curved rim, the lug lid comprising a planar surface having an annular channel on the peripheral edge of said lid; a plurality of lugs projecting downwardly from an outer wall of the channel; one or more of said lugs being asymmetrically shaped relative to the other lugs; and a plurality of circumferential bases formed between adjacent lugs.

The lug lid provides in another aspect a lug lid comprising a planar surface having an annular channel on a peripheral edge of said lid; an odd number of lugs projecting from an outer wall of the channel with one or more of said lugs comprising a male lug; and a plurality of circumferential bases formed between adjacent lugs with one or more of said circumferential bases comprising a female mating gap.

The lug lid provides in yet another aspect of the invention an odd number of lid lugs having at least some of those lugs formed in a different shape than other lugs on that lid. The ends of the lugs maybe bent or curled to facilitate removal of the lid from the container.

The invention provides in another aspect a method for making a plurality of container lids comprising the steps of forming one or more lid blanks, each blank comprising a plurality of lugs on a peripheral edge of said blanks, a plurality of circumferential bases formed between each of said lugs, one or more of said lugs comprising a male lug, and one or more of said circumferential bases having a complementary female shape for mating with said male lug; arranging the lid blanks upon a sheet of material such that each of said male lug of an adjacent lid blank is aligned and positioned within said mating circumferential base of an adjacent lid blank; cutting the lid blanks from a sheet of material; and forming a container lid from each of said blanks.

The invention provides in yet another aspect a method for making container lids comprising the steps of: forming two or more lid blanks having a plurality of lugs on the peripheral edge of the blank, with a plurality of circumferential bases formed between each of said lugs, arranging the lid blanks upon said sheet of material such that one or more of said lugs of a lid blank are interlocked with respect to lugs of an adjacent blank; cutting a plurality of lid blanks from a sheet of material; and forming a container lid from each of said blanks.

The invention provides in still another aspect a container lid prepared by the method comprising the steps of forming a plurality of lid blanks, each said blank comprising a plurality of lugs on a peripheral edge of said lid, a plurality of circumferential bases formed between each of said lugs, one or more of said lugs comprising a male lug, and one or more of said circumferential bases having a complementary shape for mating with said male lug; arranging the lid blanks patterns upon a sheet of material such that said male lug of an adjacent lid blank is positioned within said complementary shaped circumferential base of an adjacent lid blank; cutting the arranged lid blanks from a sheet of material; and forming a container lid from each of said blanks.

The method in another aspect of the invention utilizes a specially configured sheet of material designed in conjunction with the configuration of the lid blanks substantially to maximize utilization of the sheet material. In one form, the sheet material has rectangular aligned end sections with an offset center portion, the offset being formed by a trapezoid of material being added to and extending outwardly from one margin of the sheet while a trapezoidal recess of the same size and shape is provided on the other margin. This material shape permits at least three rows of lid blanks to be positioned on the material, with the center row offset from the top and bottom rows to permit adjacent lug blanks in the rows to be more closely spaced to one another.

DETAILED DESCRIPTION OF PREFERRED EMBODIMENTS

Figure 2:
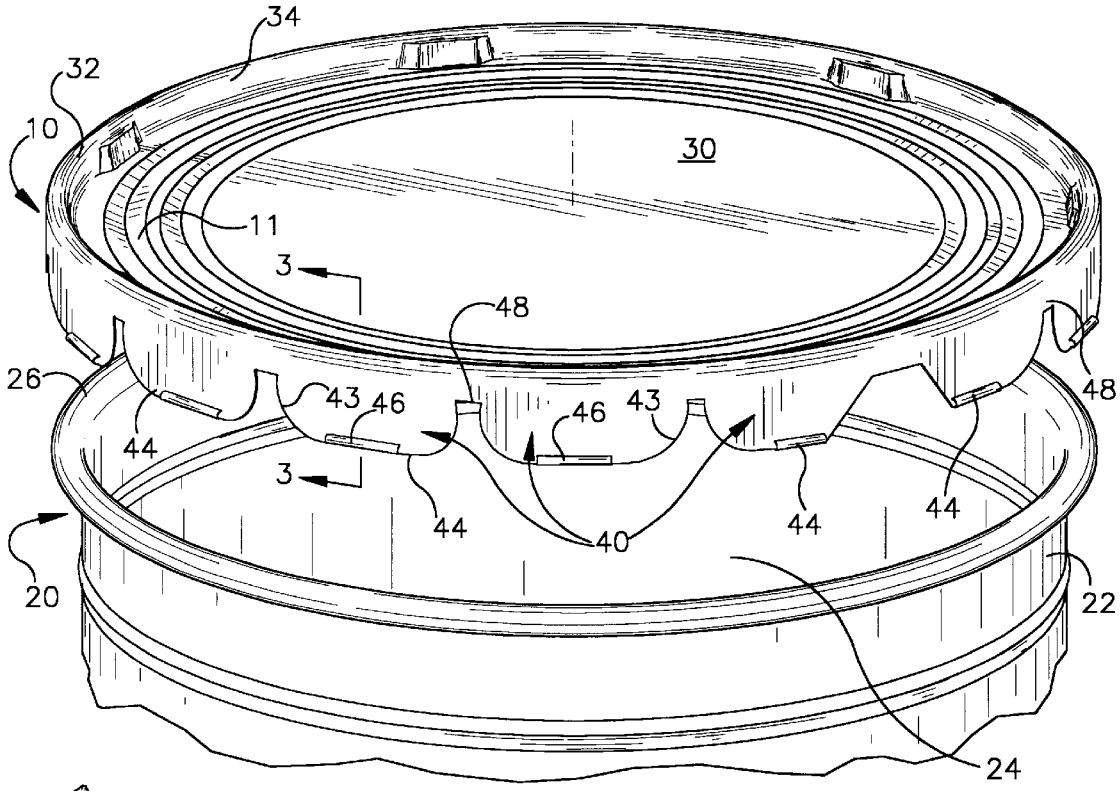
FIG. 2 is a perspective view of the container lid design of the present invention adapted to be received on a prior art container.
Figure 2A:
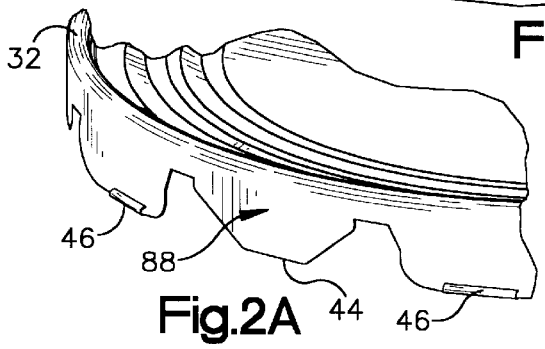
FIG. 2A is a perspective view of a portion of the container lid design showing the other side of the lid in FIG. 1.
Figure 3:
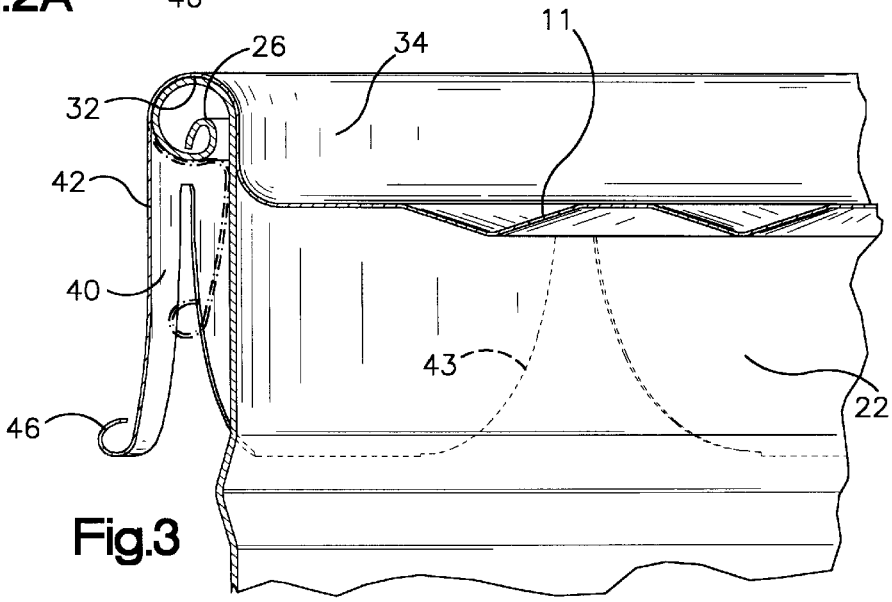
FIG. 3 is a cross section of the container lid of the present invention taken in the plane 2—2 as shown in FIG. 1.

With reference to the Figures, and more particularly to FIGS. 2 through 3, there is illustrated a new and improved container lid 10 for use in conjunction with prior art containers 20 typically made of plastic or metal. These prior art containers 20 are suitable for the storage and transportation of paint, liquids, and other flowable materials in a sealed airtight condition. These prior art containers or buckets 20 are generally formed from steel sheets or other resilient material and comprise a cylindrical container body 22 having sidewalls, a conventional closed lower end (not shown), and an open upper end 24 which cooperate to define a storage chamber. The open upper end 24 generally has a curled annular rim 26 which is formed from a curl of rolled metal or other suitable material and is adapted to receive a lug lid 10.

The lug lid 10 of the invention generally comprises a planar surface 30 preferably having a circular or disk-like shape having a plurality of annular strengthening ribs 11 and an annular downwardly facing channel 32 comprising a raised and inverted U-shaped cross section forming an outer peripheral edge 34 of the lug lid 10. The annular channel 32 is adapted to fit over and seat upon the annular rim 26 of the container 20, with the annular rim 26 being received in the annular recess of the channel 32. An optional gasket (not shown) may be seated and affixed by conventional means in the annular channel. Once the lid 10 is seated upon the container rim, a plurality of lugs 40 are crimped along the annular rim 26 of the container 20 such that the lid is in sealing engagement with the container 20.

The lugs 40 are formed about the periphery of the lug lid 10, projecting downwardly from an outer wall 42 of the annular channel 32. The lug lid 10 of the invention preferably has an odd number of lugs 40, typically in the range of 13 to 17, and preferably 15 lugs, many of which are uniquely shape. In contrast, prior art lug configurations (not shown) generally provide an even number of identically shaped lugs, on the order of 18 to 20 lugs per lid. The lugs 40 of the invention overlap the rim 26 of the container 20 when the lid 10 is seated upon the rim 26. The shapes of most of the lugs 40 generally are rectangular with curved or rounded edges 43 terminating in a flat edge 44. However, many other lug shapes would work for the invention. An optional tabular end 45 may be formed on the flat edge 44, which may be formed or bent into an upward curl 46 in order to facilitate opening of the crimped lugs 40. The optional curl 46 may be utilized to pry the crimped lugs open in order to release the lid 10. Interspaced between each of the lugs 40 are circumferential bases 48 which exist between each lug 40 in order to assist in the crimping of the lugs around the rim curl 26 of the container 20.

Figure 4:
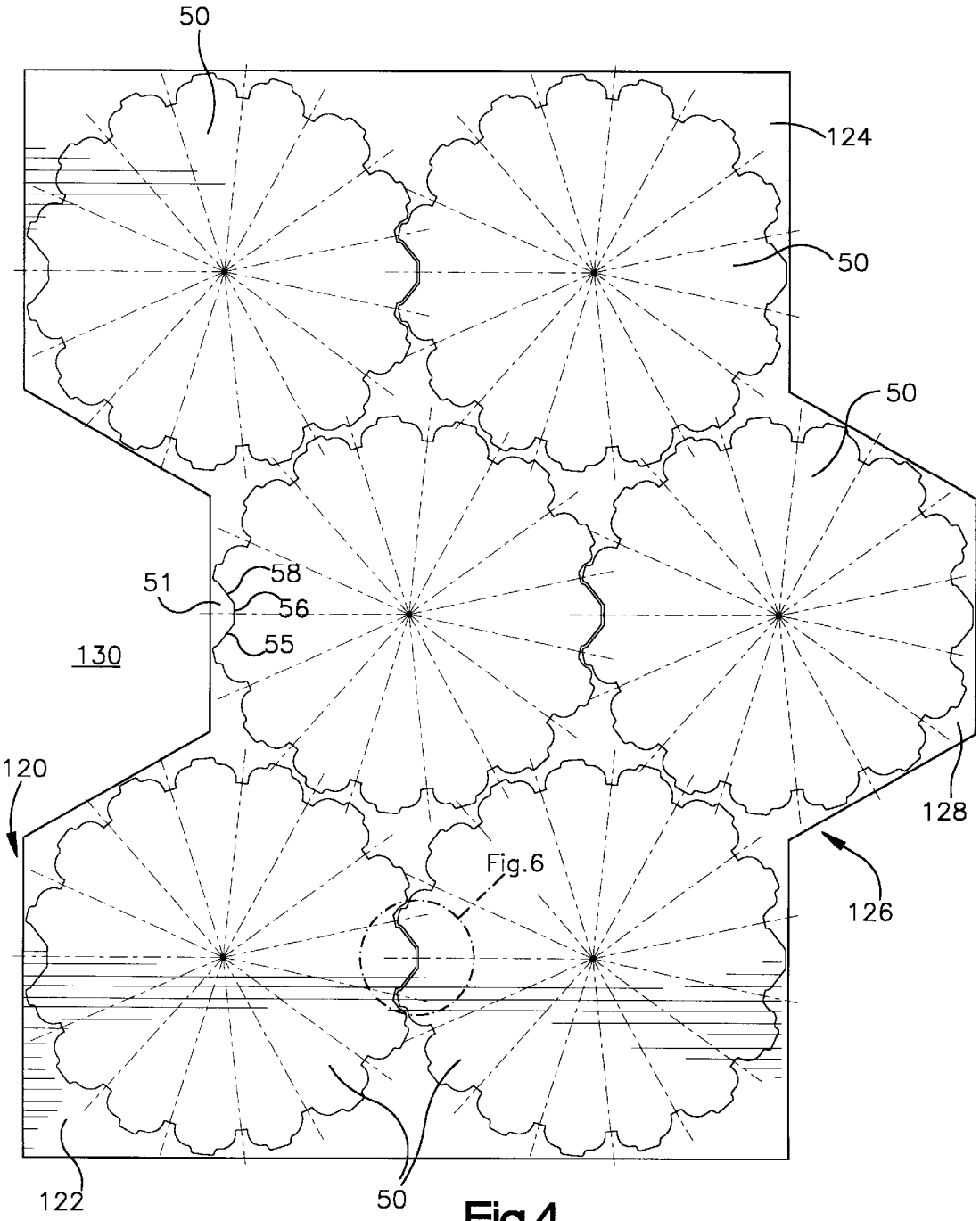
FIG. 4 is a plan view of the layout of container lid blanks of the present invention.
Figure 5:
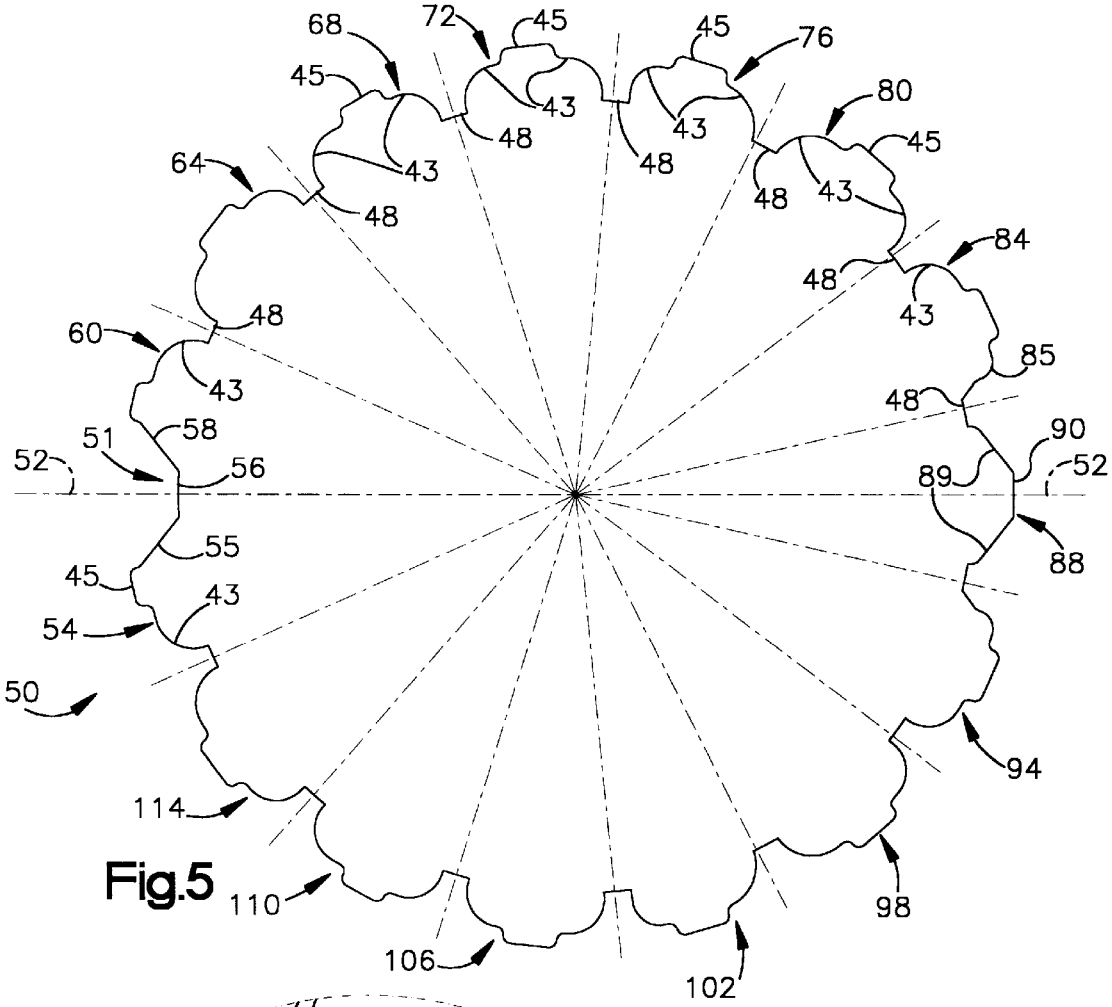
FIG. 5 is a plan view of a single container lid blank of the invention.

In contrast to the prior art however, not all of the lugs 40 are identical in shape. Almost all of the lugs 40 have different shapes and varying widths. As shown in FIG. 5, the blank lid design 50 has one plane of symmetry 52 due to the odd number of lugs and the unique shape of each lug. Beginning with lug 54 in the 9 o'clock position, lug 54 has a curved edge 43, a tabular end 45 and a truncated upper edge 55 connected to an elongated circumferential base 56 formed between lug 60 and lug 54. A truncated edge 58 of lug 60 is connected to the elongated circumferential base 56 formed between lug 60 and lug 54. These truncated edges 55,58 in combination with the elongated circumferential base 56 form a female mating base 51 which is used to facilitate the interlocking of the lid blanks 50 as shown in FIG. 4, and as explained in more detail, below. The design of lug 60 is thus the mirror image of lug 54, each of which further comprises a tabular end 45 connected to the truncated edge 55,58 and a rounded end 43 adjoining the tabular end 45.

Lugs 64, 68, 72, 76 and 80 are all very similarly shaped as a rectangle with rounded or radiused edges 43 with a tabular end 45 formed on the outer peripheral edge. Formed between adjoining lugs are circumferential bases 48 of varying widths. Lugs 64 and 68 are slightly canted towards each other, while lugs 76 and 80 are canted away from each other such that interdigitization is facilitated, as explained in more detail, below. Lug 84 is also approximately rectangular in shape with a radiused edge 43 on one end and a edge 85 that is partially radiused and partially truncated closest to the circumferential base formed between lugs 84 and 88. Lug 88 is pyramidal in shape, i.e., two inclined edges 89 joined to a circumferential edge 90 there between and forming a male lug for production purposes. Lugs 94 through 114 because of the plane of symmetry, are the mirror image of lugs 84 through 60, respectively. For example, lug 94 is the mirror image of lug 84, lug 98 is the mirror image of lug 80, etc.

Figure 1:
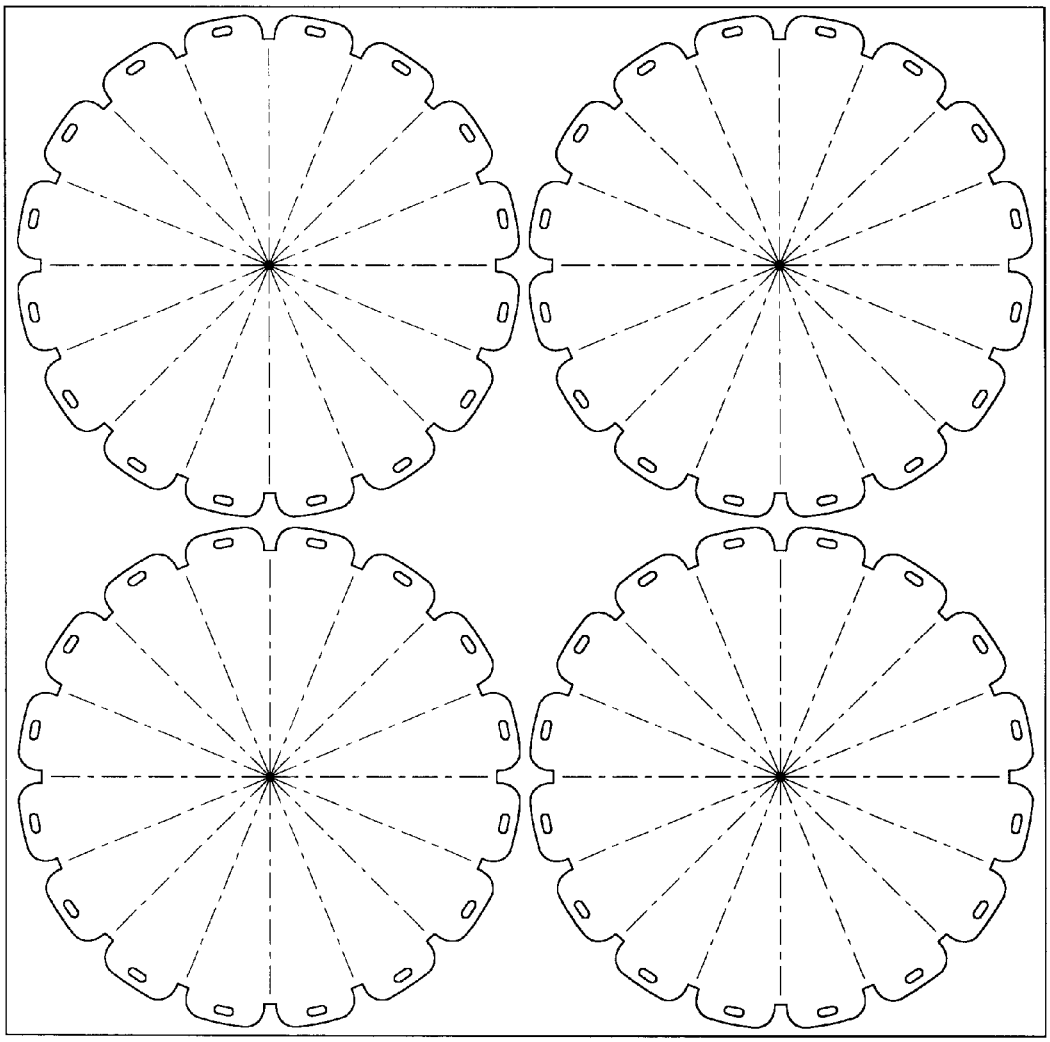
Fig.1 (PRIOR ART)
FIG. 1 is a plan view of the prior art scroll layout of container lid blanks.

The punching pattern of conventional lid blanks as shown in FIG. 1 demonstrates that the container lid blanks are sufficiently spaced apart such that the blanks do not touch each other at any place and are disposed about the same distance from each other. Punching out the lids from the material therefore necessarily results in the production of a residual punching grid or scrap skeleton which can be utilized only as scrap. Moreover, for a given lid size, a larger material surface area is required for the same number of container lids for the prior art design as compared to the design and layout of the invention.

Figure 6:
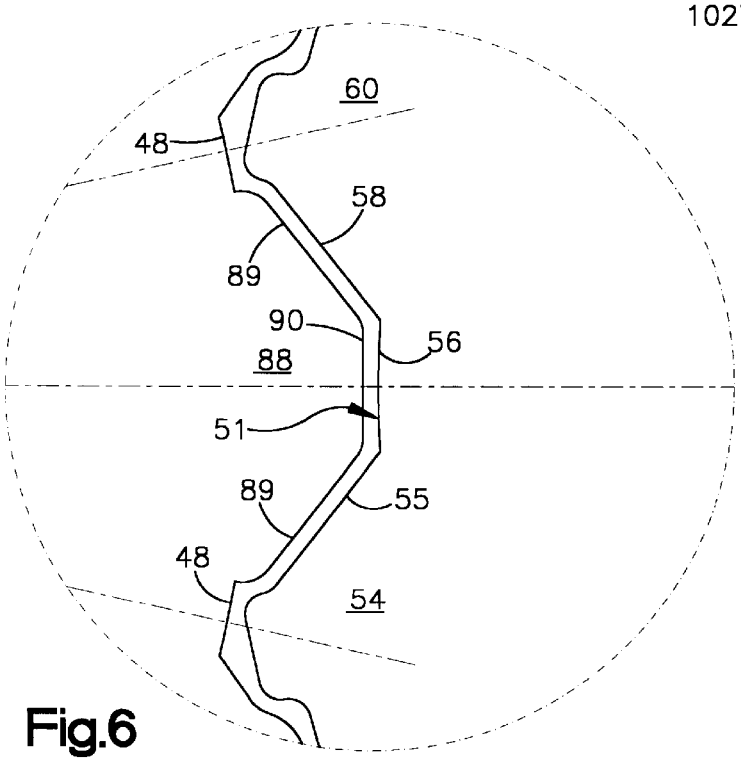
FIG. 6 is a greatly enlarged portion of FIG. 4 showing the interface of mating lugs of adjacent container blanks.

FIG. 4 shows the punching pattern of six container lid blanks 50 of the invention from a scrolled sheet of metal. FIG. 4 illustrates three rows of container lid blanks comprised of 2 lid blanks in each row, with the center row being offset from the top and bottom rows. In each row, the male lug 88 of the container lid blank is aligned with, and placed between the female circumferential base 51 formed between the lugs of the adjacent container lid blank, leaving a very thin scrap skeleton as shown in FIG. 6. The container lid blank lugs in the adjacent rows are aligned with and placed closely between the circumferential bases of the adjoining container lid blanks. Thus the container lid lugs are interdigitated or interlocked with the lugs in the adjacent rows, analogous to gear teeth between mating gears.

This relationship between the respective lid blanks and lid rows minimizes the amount of material between the lid blanks and thus minimizes the scrap skeleton remaining when the lids have been removed from the sheet material. The design of the odd number of specially configured lid lugs, the layout of the lid blanks and offset lid blank rows and the shape of the sheet material contribute to the efficiency of the process. In the preferred form the scrolled sheet material, indicated generally at 120, has two rectangular ends 122 and 124 and an offset central section, indicated generally at 126. The offset central section 126 is formed by a trapezoidal piece 128 being added to and extending outwardly from one side or margin of sheet material 120 and a similarly shaped and sided trapezoidal recess 130 being provided on the other side.

Figure 7:
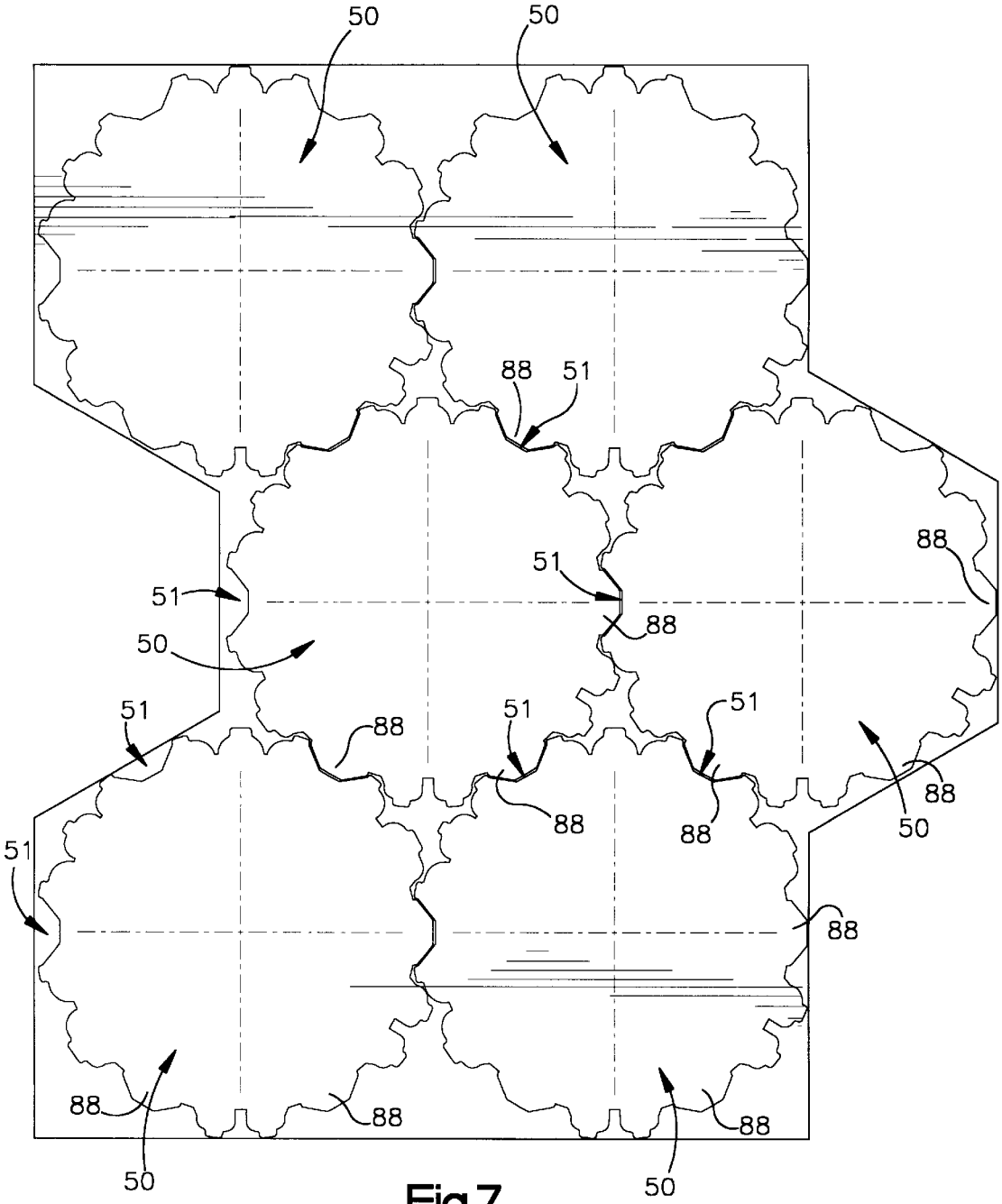
FIG. 7 is a plan view of an alternative embodiment of the pattern layout of container lid blanks of the present invention.

In an alternative embodiment of the invention, the container lid blank 50 may comprise three or more female circumferential bases 51 and three or more male shaped lugs 88, such as shown in FIG. 7. The male lugs 88 and the female circumferential bases 51 are alternated on a container lid blank 50. Thus as shown, the layout of the container blanks 50 in the middle row are such that the female circumferential bases 51 and the male lugs 88 are positioned for alignment with the adjacent male lugs 88 and female circumferential bases 51.

Figure 8:
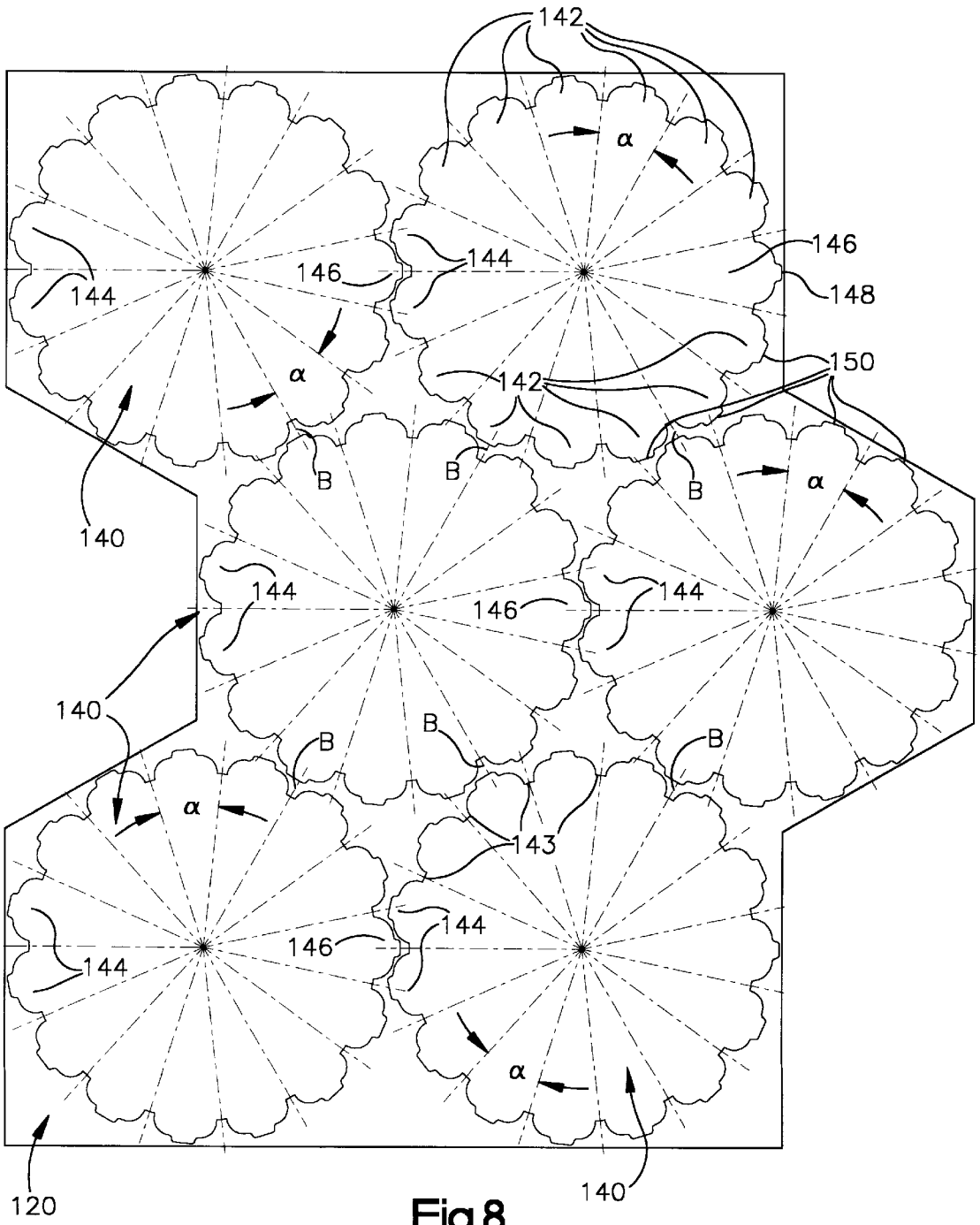
FIG. 8 is a plan view of an alternative embodiment of the pattern layout of container lid blanks of the present invention.

In yet another alternative embodiment of the invention as shown in FIG. 8, the container lid blank 140 comprises an odd number of symmetrically shaped lugs 143 with circumferential bases 144 formed between each lug. Preferably, the blank has 15 lugs, with each lug having the same angular displacement $\alpha$. It is additionally preferred that the circumferential bases 143 be the same. Lug 146 is symmetrically shaped, but has a narrower tabular extension 148 than the tabular extensions 150 of the other lugs 142. Directly opposite lug 146 are two adjacent lugs 144, which are canted away from each other to allow lug 146 to be disposed between, or interlocking with respect to, the adjacent lugs 144 on an adjacent blank when the blanks are layed out. In addition, lugs 142 are additionally interlocking with respect to lugs 142 on an adjacent blank on the locations identified with the letter "B". Thus, the container blanks 140 are preferably arranged upon a scrolled sheet of material 120 as described above, with the blanks arranged in two or more rows in a tightly spaced configuration. The middle row is offset from the outer rows to allow closer spacing of the blanks 140. In addition, each row has the blank lug 146 interlocking with respect to the adjacent blank lugs 144.

Although the invention has been disclosed and described with respect to certain preferred embodiments, certain variations and modifications may occur to those skilled in the art upon reading this specification. For example, the invention could be utilized on a cover that is not round nor which contains a annular channel or an annular rim section. Any such variations and modifications are within the purview of the invention notwithstanding the defining limitations of the accompanying claims and equivalents thereof.

I claim:

1. A lug lid for sealing a container having a rim, the lug lid comprising:

a planar surface having a channel on a peripheral edge of said lid;

a plurality of lugs projecting from an outer wall of the channel;

one or more of said lugs being asymmetrically shaped relative to the other lugs; and a plurality of bases formed between adjacent lugs.

2. The lug lid as in claim 1 wherein said lid has one plane of symmetry.

3. The lug lid as in claim 1 wherein said lid has only one plane of symmetry.

4. The lug lid of claim 1 wherein one or more of said lugs is a male lug and one or more of said bases are female.

5. The lug lid of claim 1 wherein said lid comprises a first half and a second half with each half being the mirror image of the other; with the lugs on said halves being uniquely shaped.

6. The lug lid as in claim 1 wherein all of said lugs are asymmetrically shaped.

7. The lug lid as in claim 1 comprising an odd number of lugs.

8. The lug lid as in claim 1 wherein one or more lugs are canted.

9. The lug lid of claim 1 wherein said lid is generally disc shaped.

10. A lug lid comprising:

a planar surface having a channel on a peripheral edge of said lid;

an odd number of lugs projecting from an outer wall of the channel with one or more of said lugs comprising a male lug; and a plurality of circumferential bases formed between adjacent lugs with one or more of said circumferential bases comprising a female mating gap.

11. The lug lid as in claim 10 wherein said male lug comprises a generally pyramidal shape.

12. The lug lid in claim 10 wherein said female mating gap is generally pyramidally shaped.

13. The lug lid as in claim 10 wherein one or more of said lugs are canted away from an adjacent lug.

14. The lug lid as in claim 10 wherein some of said lugs are generally rectangular in shape and with rounded edges.

15. The lug lid as in claim 10 further including a curl at the end of at least some of the lugs to facilitate removal of the lid from the container.

16. The lug lid as in claim 10 comprising 15 lugs.

17. The lug lid as in claim 10 having a circular shape.

18. A lug lid for closing an open end of a container comprising a generally planar surface and a plurality of an odd number of lugs projecting from the periphery of the generally planar surface, at least one of said lugs having a different shape than the other said lugs.

* * * * *